US007059179B2

(12) United States Patent
Proett et al.

(10) Patent No.: US 7,059,179 B2
(45) Date of Patent: Jun. 13, 2006

(54) MULTI-PROBE PRESSURE TRANSIENT ANALYSIS FOR DETERMINATION OF HORIZONTAL PERMEABILITY, ANISOTROPY AND SKIN IN AN EARTH FORMATION

(75) Inventors: Mark A. Proett, Missouri City, TX (US); Wilson C. Chin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 611 days.

(21) Appl. No.: 10/254,310

(22) Filed: Sep. 25, 2002

(65) Prior Publication Data

US 2003/0094040 A1 May 22, 2003

Related U.S. Application Data

(60) Provisional application No. 60/325,903, filed on Sep. 28, 2001.

(51) Int. Cl.
*E21B 49/00* (2006.01)

(52) U.S. Cl. ..... 73/152.05; 73/152.03

(58) Field of Classification Search ..... 73/152.02, 73/152.03, 152.51, 152.18, 152.29, 152.05
See application file for complete search history.

(56) References Cited

U.S. PATENT DOCUMENTS 2,747,401 A * 5/1956 Henri-Georges ..... 73/152.05
4,043,192 A * 8/1977 Shuck ..... 73/152.41
4,742,459 A * 5/1988 Lasseter ..... 702/12
4,890,487 A * 1/1990 Dussan V. et al. ..... 73/152.05
5,230,244 A * 7/1993 Gilbert ..... 73/152.17
5,247,830 A * 9/1993 Goode ..... 73/152.51
5,335,542 A * 8/1994 Ramakrishnan et al. . 73/152.08
5,602,334 A * 2/1997 Proett et al. ..... 73/152.05
5,672,819 A * 9/1997 Chin et al. ..... 73/152.41
5,703,286 A * 12/1997 Proett et al. ..... 73/152.05
5,770,798 A * 6/1998 Georgi et al. ..... 73/152.05
6,164,126 A * 12/2000 Ciglenec et al. ..... 73/152.01
6,585,045 B1 * 7/2003 Lee et al. ..... 166/252.5
6,964,301 B1 * 11/2005 Hill et al. ..... 166/264

OTHER PUBLICATIONS

M.A. Proett, W.C. Chin and B. Mandal, "Advanced Permeability and Anisotropy Measurements While Testing and Sampling in Real-time Using a Dual Probe Formation Tester", Society of Petroleum Engineers, Paper No. 62919, Oct. 2000.

M.A. Proett, W.C. Chin and B. Mandal, "Advanced Dual Probe Formation Tester with Transient, Harmonic, and Pulsed Time-Delay Testing Methods Determines Permeability, Skin, and Anisotropy". Society of Petroleum Engineers. Paper No. 64650. Nov. 2000.

* cited by examiner

*Primary Examiner*—Hezron Williams
*Assistant Examiner*—John Fitzgerald
(74) *Attorney, Agent, or Firm*—Conley Rose, PC; Mark E. Scott

(57) ABSTRACT

The specification discloses a downhole tool that determines hydraulic permeability of a downhole formation taking into account one or both of the dip angle of the borehole relative to the formation, and damage to the borehole wall and invasion of borehole fluid—collectively referred to as skin.

31 Claims, 3 Drawing Sheets

MULTI-PROBE PRESSURE TRANSIENT ANALYSIS FOR DETERMINATION OF HORIZONTAL PERMEABILITY, ANISOTROPY AND SKIN IN AN EARTH FORMATION

CROSS-REFERENCE TO RELATED APPLICATIONS

This application claims the benefit of Provisional Application Ser. No. 60/325,903, which is incorporated herein by reference as if reproduced in full below.

STATEMENT REGARDING FEDERALLY SPONSORED RESEARCH OR DEVELOPMENT

Not applicable.

BACKGROUND OF THE INVENTION

1. Field of the Invention

The preferred embodiments of the present invention generally relate to determining hydraulic permeability of earth formations traversed by a borehole. More particularly, the preferred embodiments are directed to determining permeability anisotropy of the earth formations. More particularly still, the preferred embodiments are directed to determining the hydraulic permeability, permeability anisotropy and skin using an analytic model that considers the storage effect downhole, as well as the dip angle of the formation relative to the borehole.

2. Description of the Related Art

It is well known that some earth formations exhibit anisotropic properties. That is, certain downhole parameters may have more distinctive qualities, or may be more pronounced, in one physical direction than another. While there may be many properties that exhibit this characteristic, this specification is directed to determining the hydraulic permeability anisotropy of the earth formations.

Permeability is a measure of how easily fluids flow through a particular environment. Earth formations having a very high permeability may flow greater volumes of liquids than formations having a low permeability for the same pressure differentials. Because of the way earth formations are formed, typically horizontal layer upon horizontal layer, the permeability of earth formations is generally higher in a direction substantially parallel to the layers of earth formation. Likewise, the permeability is generally lower in directions perpendicular to the layers of the earth formation. While it is generally true that the horizontal permeability is greater than the vertical permeability, this need not necessarily be the case.

Permeability of a formation generally may be determined by inducing a fluid flow from the formation into a test apparatus, and measuring the pressure differential created by the induced flow. If the testing is performed with only a single probe, then the permeability determined is spherical permeability and indistinguishably contains both the horizontal and vertical permeability components. That is, using a single probe, and inducing a flow, the flow of formation fluids comes not only from locations within the formation on the same plane as the probe, but also from above and below. Thus, using only a single probe, while giving the ability to determine the permeability generally, is not sufficient to ascertain the horizontal and vertical components of the permeability. Related art devices compensate for this inability to determine both the horizontal and vertical permeability by having two probes vertically spaced apart.

In particular, related art devices may include a source probe at a first elevation, and a second probe vertically displaced from the first probe. Further, some devices may also include a third probe at the same elevation as the first probe, but azimuthly rotated therefrom, for example, U.S. Pat. No. 5,247,830. By inducing either positive or negative pressure within the formation at the source probe (by forcing fluid flow into or out of the formation respectively), and detecting pressure response at the other probes, it is possible to determine both the horizontal and vertical components of the overall permeability of the formation. However, there are aspects of a borehole traversing an earth formation that are not determined or compensated for in devices such as those described in the U.S. Pat. No. 5,247,830.

Drilling of earth formations typically involves a drill bit at the end of a drill string cutting or chipping away pieces of the formation. Drilling fluid, also known as "mud," flows through an inside diameter of the drill string, through jets on the drill bit, and then back up through the annular region between the drill string and the borehole wall. The mud serves several purposes. First, the mud moving past the drill bit acts to cool and lubricate the bit. Secondly, the circulation of drilling mud through the annular region carries cuttings away from the drill bit. Finally, the drilling mud has a specific density such that the pressure within the borehole as it traverses earth formations is greater than the pressure of fluid or gas within the formations, thereby forcing the downhole hydrocarbons to remain within the formation rather than entering the borehole. If the pressure of the drilling fluid is not carefully maintained, it is possible for the downhole hydrocarbons to enter the borehole and/or expand under the reduced pressure pushing the drilling mud back toward the surface, known as "kick."

The rather violent process of drilling through an earth formation, in combination with the drilling mud present during the process, affects the downhole formation's ability to produce hydrocarbons. In particular, the act of drilling tends to damage, even if slightly, the formation immediately adjacent to the borehole wall. This damage may affect the permeability of the formation in this location. Further, the presence of the drilling mud at pressures greater than the formation results in invasion of the mud into the formation. This too tends to affect the permeability of the formation at locations adjacent to the borehole. While related art devices have advanced in their ability to determine both the horizontal and vertical components of the permeability in downhole formation, they are not capable of accounting for the affects of the formation damage and invasion of the drilling fluid near the borehole wall—which combination of factors is collectively known in the industry as "skin." The effect of the skin on the measured permeability may be as high as an order of magnitude, thus contributing substantially to error in related art permeability determinations, as they do not take skin into account. Other factors too introduce error into related art determinations of permeability anisotropy, like compressibility of formation fluids and dip angle of the formation.

With the advent of directional drilling, it is now possible, indeed probable, that any particular borehole may not be substantially vertical. That is, as the direction and inclination of the drilling process changes, the borehole may cross otherwise substantially horizontal earth formations at an angle. Thus, the axis of the borehole at any particular location may have an angle of inclination, also known as the "dip angle," with respect to the direction of horizontal permeability. This difference in the angle between the axis of the borehole and the direction of horizontal permeability may also manifest itself where an otherwise vertical borehole crosses an earth formation itself having an inclination. Regardless of why the dip angle is present, the difference between an assumed horizontal permeability normal to the borehole axis and the actual horizontal permeability affects the determination of the actual horizontal and vertical permeability. Related art permeability testing devices do not compensate for the dip angle.

Thus, what is needed in the art is a structure and related method for determining horizontal and vertical permeability, and thus the anisotropy of the earth formation, that takes into the account skin and dip angles of the well bore, as well as any other downhole parameter which may affect a measurement, such as the storage effect caused by compressibility of the formation fluids.

SUMMARY OF SOME OF THE PREFERRRED EMBODIMENTS

The problems noted above are solved in large part by a formation tester comprising two probes. Collecting data regarding formation pressure starts by fluidly coupling the probes to the formation walls. At least one of the probes creates a pressure gradient which is sensed by the related probe. The pressure data obtained is then applied to a series of analytic models which take into account the skin of the formation, the dip angle encountered and the storage effects downhole.

Using numerical regression analysis techniques, the preferred embodiments manipulate the parameters of the analytic model until the pressure response predicted by the model matches the actual pressure response. Once this is complete, the formation parameters such as permeability and skin are available in the solved model. In embodiments where one probe is used, the analytic model calculates spherical permeability taking into account one or both of the skin and dip angle. Where two probes are used, the analytic model calculates both horizontal and vertical permeability (and therefore anisotropy) taking into account one or both of skin and dip angle.

The disclosed device and methods comprise a combination of features and advantages which enable them to overcome the deficiencies of the prior art devices. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the preferred embodiments, reference will now be made to the accompanying drawings, wherein.

NOTATION AND NOMENCLATURE

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ".

The following table of exemplary terms is provided to aid in understanding the various parameters of the equations given below:

| |
|---|
| $c$ = total compressibility (l/psi) |
| $c_d$ = dimensionless compressibility |
| $k_s$ = skin permeability (md) |
| $k_f$ = formation spherical permeability (md) |
| $k_z$ = vertical permeability (md) |
| $k_r$ = horizontal permeability (md) |
| $p$ = pressure (psi) |
| $p_d$ = dimensionless pressure |
| $P(t)$ = measured pressure (psi) |
| $\Delta P_p$ = source probe pressure differential (psi) |
| $\Delta P_z$ = vertical probe pressure differential (psi) |
| $Q(t)$ = volume flow rate ($cm^3/s$) |
| $Q_o$ = draw-down flow rate ($cm^3/s$) |
| $r$ = spherical coordinate (cm) |
| $r_d$ = dimensionless radius |
| $r_{dv}$ = dimensionless probe spacing |
| $r_p$ = physical source radius |
| $r_s$ = equivalent spherical source radius (cm) |
| $r_v$ = vertical probe spacing length (cm) |
| $S$ = skin factor |
| $S_d$ = dimensionless skin factor |
| $t$ = time (sec) |
| $t_d$ = dimensionless time |
| $x, y, z$ = Cartesian coordinates (cm) |
| $\mu$ = formation fluid viscosity (cp) |
| $\phi$ = formation porosity |
| $\lambda$ = anisotropy ($k_z/k_r$) |
| $\tau$ = constant related to borehole radius |
| $\tau_s$ = source probe geometric shape factor |
| $\tau_v$ = vertical probe geometric shape factor |

DETAILED DESCRIPTION OF THE PREFERRED EMBODIMENTS

This application is directly related to the Society of Petroleum Engineers Conference Paper SPE 64650 titled "Advanced Dual Probe Formation Tester with Transient, Harmonic, and Pulsed Time-Delay Testing Methods Determines Permeability, Skin and Anisotropy," which is incorporated herein by reference as if reproduced in full below. This application is also related to the Society of Petroleum Engineers Paper SPE 62919 titled "Advanced Permeability and Anisotropy Measurements While Testing and Sampling in Real-Time Using a Dual Probe Formation Tester," which is also incorporated herein by reference as if reproduced in full below.

Figure 1:
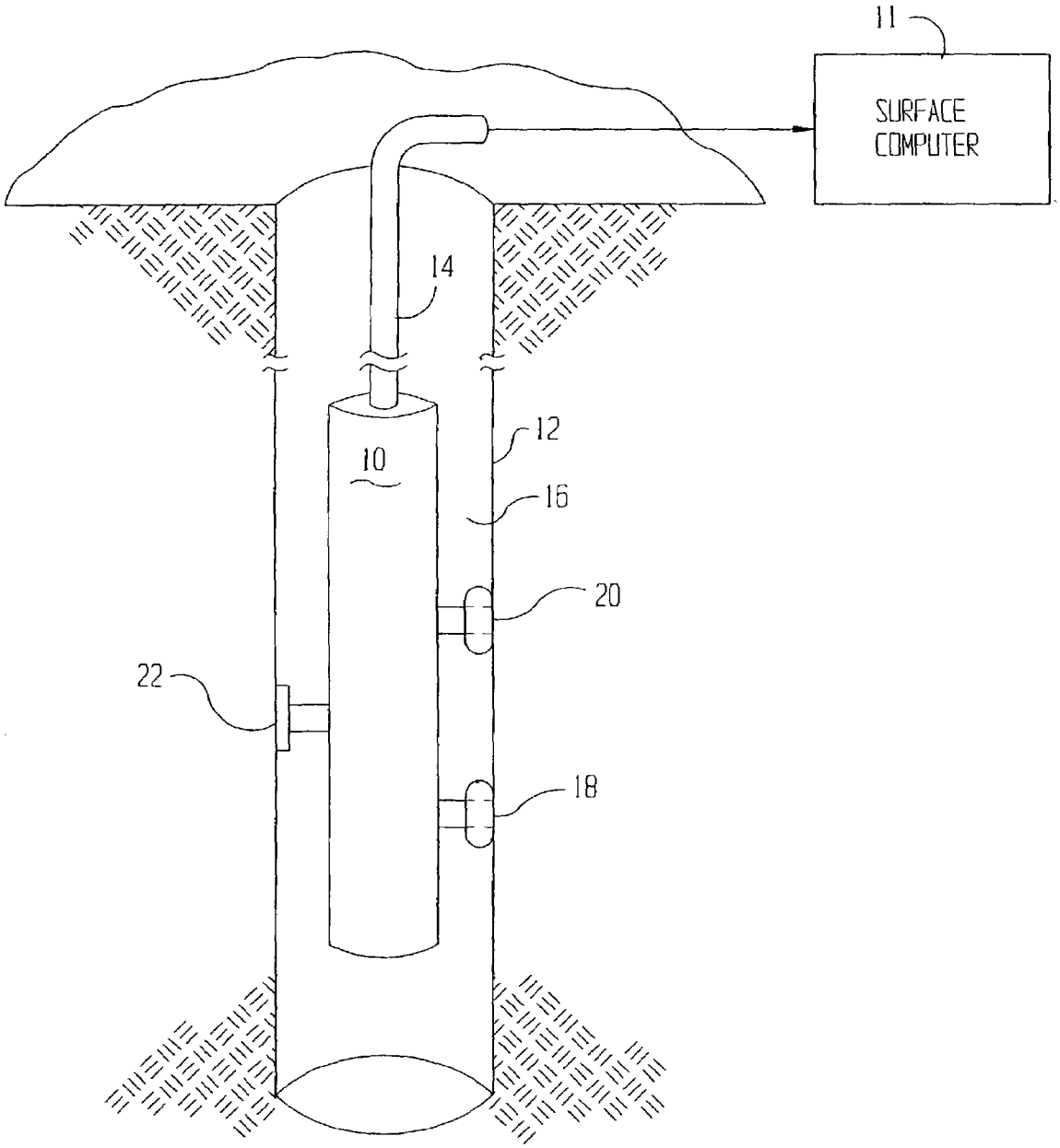
FIG. 1 shows a wireline formation testing tool of the preferred embodiments.

FIG. 1 shows a wireline formation tester 10 constructed in accordance with the preferred embodiments. In particular, the wireline formation tester is preferably disposed within a borehole 12 traversing earth formations. The wireline formation tester 10 is preferably suspended by an armored multi-conductor cable 14, which not only supports the formation tester 10 within the borehole, but also provides electrical communication pathways between the borehole 10 and a surface computer 11. In the preferred embodiments, the surface computer 11 controls activities of the various downhole devices, and records parameters monitored during testing. The surface computer 11 also performs the modeling, described below, to determine the formation parameters in a post processing system (after the probe response are recorded). The volume between the wireline formation tester 10 and the borehole 12 may be filled with drilling fluid 16 whose specific gravity creates pressure at each depth which is greater than the formation pressure.

In order to make the permeability determinations, the wireline formation tester 10 preferably comprises a lower or source probe 18 which may be extended from the tool 10 body to be in fluid communication with the formation, as shown in FIG. 1. Likewise, the tool 10 comprises an upper or vertical probe 20, which is also extendable away from the tool body to be in fluid communication with the formation 12. In order that sufficient pressure may be placed on the probes 18, 20 to seal them against the formation wall, the wireline formation tester 10 also preferably comprises one or more stabilizers 22 placed on the opposite side of the tool body. While only one such stabilizer is shown, any number of stabilizers may be used, and their placement is not critical so long as sufficient force may be applied to the probes 18, 20 to seal them against the formation wall.

Figure 2A:
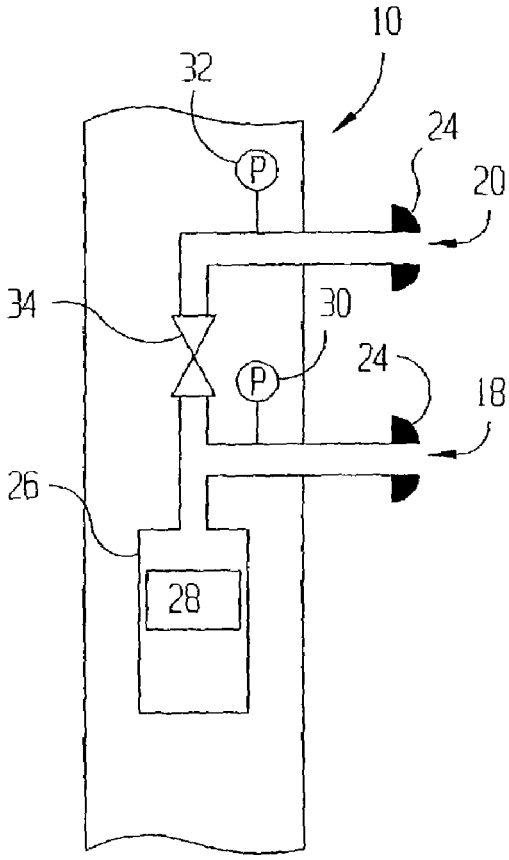
FIG. 2A shows an internal schematic of the relevant portions of the wireline formation tool for small draw-down tests.

Referring now to FIG. 2A, there is shown a schematic diagram of the relevant portions of the wireline formation tester 10 for performing small draw-down tests. In particular, the tool 10 comprises the source probe 18 and vertical probe 20, as discussed with respect to FIG. 1. On the ends of each of the probes 18, 20 are seals 24, of which one of ordinary skill in the art is fully aware, that aid in sealing of the probes 18, 20 against the formation wall 12. Each of the probes 18, 20 are preferably fluidly coupled to a cylinder or chamber 26. The chamber 26 preferably has disposed therein a piston 28. By displacing the piston 28 within the chamber 26, formation fluids are pulled through one or more of the probes 18, 20 into the chamber 26. Alternatively, each probe could have its own piston and chamber. Except for acceleration and deceleration times of the piston 28, it is preferred that the movement of the piston, and thus the increasing volume within its respective chamber, provides a constant fluid flow rate from the formation. Referring still to FIG. 2, preferably each of the probes 18, 20 has an associated pressure transducer, being pressure transducer 30 for the source probe 18 and transducer 32 for the vertical probe 20.

Figure 3:
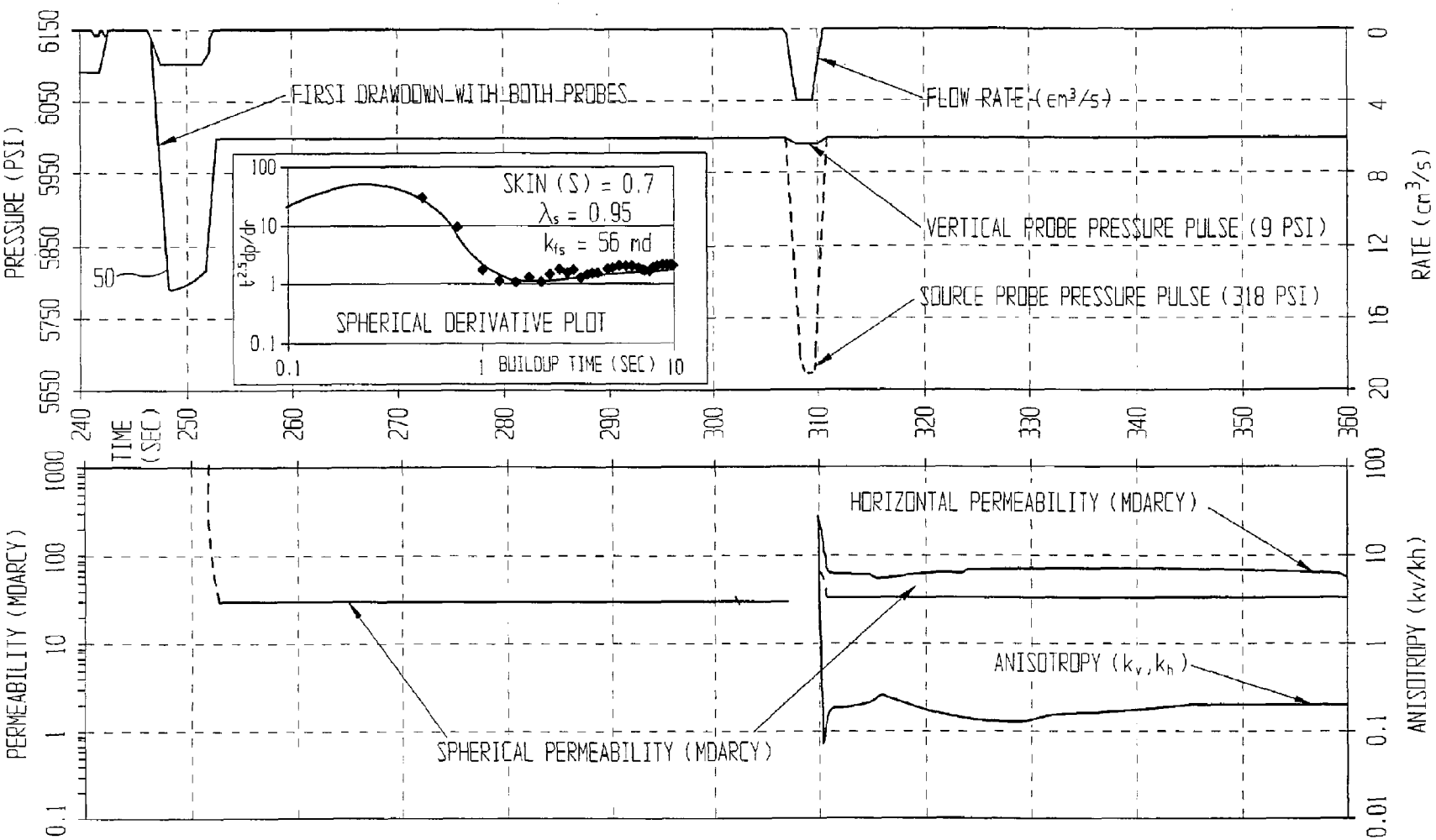
FIG. 3 shows an exemplary set of data for a small draw-down permeability test.

A sequence for determining the permeability of the formation will now be described referring simultaneously to FIGS. 2A and 3. Preferably, the wireline formation tool 10 is placed within the borehole at a particular depth level of interest. The probes 18, 20 are extended to be in fluid communication with the formation, and likewise stabilizer 22 is extended to aid in providing sufficient force for sealing the probes 18, 20 against the formation. Initially, valve 34 is open and thus both the source probe 18 and the vertical probe 20 are in fluid communication with the chamber 26 and piston 28. As shown in FIG. 3, the pressure transducers 30, 32 initially sense the hydrostatic pressure within the borehole, which in the exemplary drawing is shown by line 50 and is between 6,050 and 6,150 pounds per square inch (psi). With valve 34 open, the piston 28 is displaced within its chamber 26 causing a fluid flow from the formation through the probes 18, 20. Because of the permeability or resistance to flow of the formation, the pressure transducers 30, 32 sense a pressure drop, as indicated by the terms "First Drawdown with Both Probes" in FIG. 3. After approximately five seconds, the initial flow or draw-down ceases and each of the pressure transducers 30, 32 begin to sense formation pressure, which is lower than the hydrostatic pressure of the drilling mud within the borehole. In the exemplary drawings of FIG. 3, the formation pressure is approximately 6,000 psi. After giving the formation time to stabilize from the initial draw-down, a second flow or draw-down is performed. Prior to the second draw-down however, the valve 34, which was open in the initial draw-down, is closed. Once the vertical probe 20 is isolated from the source probe 18 by way of valve 34, the piston 28 is again displaced within its chamber 26, thereby drawing fluids from the formation through the source probe 18. The piston 28 moving downward within its chamber 26 draws fluid from the formation by creating a differential pressure between the formation and the piston. The differential pressure created is that which is necessary to move the additional volume created by the piston moving within its cylinder. Because the volume rate of flow in the second draw-down test is preferably greater than the volume rate of flow in the initial draw-down test, in one embodiment the second draw-down preferably taking approximately four cubic centimeters per second, and also because the vertical probe 20 is isolated from the piston during the second draw-down test by way of closed valve 34, the drop in pressure sensed by pressure transducer 30 associated with the source probe 18 is typically greater than that pressure drop sensed during the initial draw-down test. The pressure sensed as a function of time by the transducer 30 is shown in the exemplary drawing of FIG. 3 in dashed lines.

Although the vertical probe 20 is isolated during the second draw-down test, because of its relatively close spacing to the source probe, in the preferred embodiments from six to twelve inches, and because the vertical probe 20 is in fluid communication with the formation, it too senses a pressure drop which has propagated through the formation from the source probe 18 to the vertical probe 20. The exemplary drawing of FIG. 3 shows a pressure drop sensed by the pressure transducer 32, on the order of 9 psi, compared to a source probe sensed pressure drop of approximately 318 psi in the exemplary system.

Figure 2B:
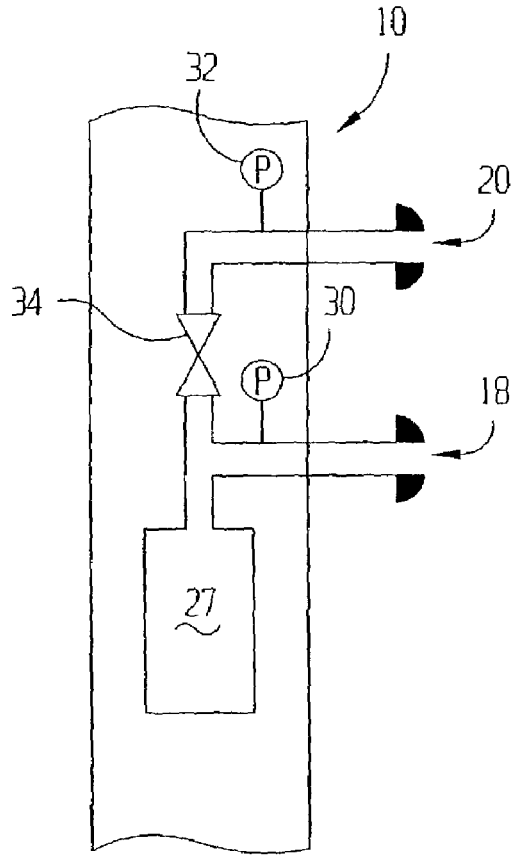
FIG. 2B shows an internal schematic of the relevant portions of the wireline formation tool for large draw-down tests.

In a second sequence for determining the permeability of the formation, pumping of fluid from the source probe 18 during the second draw-down takes place for an extended period of time. That is, after each probe is coupled to the formation and reads formation pressure (first draw-down), the two probes are isolated from each other using valve 34, and fluid is pumped through the source probe 18 for an extended period of time. FIG. 2B shows tool 10 for performing large or extended draw-down tests having the chamber 26 and piston 28 replaced by a pump 27. In this arrangement, pump 27 is preferably a positive displacement pump, which could comprise a chamber and piston arrangement similar to that of FIG. 2A. In the extended pump down procedure, preferably the fluid is pumped through the source probe 18 (discharged into the borehole) at a rate of approximately one-half gallon a minute for approximately one-half hour. Thereafter, the pumping is stopped and the pressure responses sensed by the source probe 18 and the vertical prove 20 (pressure transducer 30 and 32 respectively) are monitored and recorded. For the extended pump-down test, recording times may range, depending on the formation, from ten to thirty minutes, but preferably fifteen minutes.

Determining the formation properties of interest of the preferred embodiment involves applying the waveforms representing the pressure sensed by the pressure transducers 30, 32 during the second draw-down test (whether the short draw-down taking only a few cubic centimeters or the extended draw-down test taking several gallons), such as those exemplified in FIG. 3, to an analytic model. In particular, the analytic model takes into account permeability of the skin, the storage effect downhole, as well as the dip angle of the formation relative to the borehole. The equation of the analytic model for the pressure response of the source probe during a draw-down test is:

$$\Delta P_p(r_p, t) = \left(\frac{(1+S_d)\mu}{k_f}\frac{Q_0}{4\pi}\frac{\tau_s}{r_p}\right)\left\{\frac{p_{ds}(c_d, S_d, t_d)}{(1+S_d)}\right\} \quad (1)$$

where $\Delta P_p$ is the pressure response detected at the source probe 18 as a function of source probe radius $r_p$ (which is related to equivalent source probe radius $r_s$) and time t, and where $S_d$ is a dimensionless skin constant, $\mu$ is the formation fluid viscosity, $k_f$ is the spherical permeability, $Q_0$ is the draw-down flow rate, $\tau_s$ is a geometric shape factor to make corrections to the source probe radius, and $p_{ds}$ is the source pressure transient as a function of the dimensionless compressibility factor $c_d$, the dimensionless skin $S_d$ and dimensionless $t_d$. Before going on to more thoroughly define the various terms of equation (1) above, it is noted that the portion of the equation within parenthesis represents the static response of the analytic model, and the portion within the brackets represents the transient response of the analytic model.

The $k_f$ term within the denominator of the static response portion of equation (1) above is the spherical permeability. The spherical permeability is made up of both horizontal and vertical permeability components. Generally, $k_f$ is defined as:

$$k_f = \sqrt[3]{k_r^2 k_z} \quad (2)$$

where $k_r$ is the horizontal permeability, and $k_z$ is the vertical permeability. The permeability $k_f$, including its horizontal and vertical components $k_r$ and $k_z$ respectively, are some of the unknowns to be determined using equation (1) above, as well as equation (14) with regard to the vertical probe, discussed below. The dimensionless skin factor, $S_d$ is given by the equation:

$$S_d = \frac{S}{\zeta} \quad (3)$$

where S is the skin factor and $\zeta$ is calculated by:

$$\zeta = \frac{1}{\sqrt[3]{\lambda}}\left(\frac{1}{2} + \frac{\sqrt{\lambda}\arcsin\left(\sqrt{1-1/\lambda}\right)}{2\sqrt{1-1/\lambda}}\right) \quad (4)$$

where $\lambda$ is the anisotropy defined as the ratio of the vertical to horizontal permeability:

$$\lambda = \frac{k_z}{k_r} \quad (5)$$

and where S is defined as:

$$S = \frac{\delta}{r_s}\frac{k_f}{k_s}. \quad (6)$$

where $\delta$ is the skin thickness. The $Q_o$ term from equation (1) is the flow rate used in the draw-down test. In the exemplary plot shown in FIG. 3, the flow rate $Q_o$ for the second draw-down used is 4 $cm^3/s$. The term $\tau_s$ in the static portion of equation (1) is a geometric shape factor used to make corrections to the source probe radius $r_p$ that include geometric considerations in actual wireline formation testing applications. In particular, the analytic model exemplified, in part, by equation (1) above, was tested in the context of a finite element model and analysis. In that finite element model, the physical source used was a circular area projected against the side of a cylindrical borehole. The analytical solution, however, was developed assuming the physical source as a spheroid. The geometric shape factor $\tau_s$ thus compensates the analytical model for the difference in source geometries. Finally the geometric shape factor can be defined as $$\tau_s = 2\tau\zeta \quad (7)$$

where $\tau$ is determined by the finite element model and $\zeta$ is as given above. The value of $\tau$ changes based, at least in part, on the diameter of the particular borehole. In general, $\tau$ ranges from approximately 1 for large diameter boreholes, to approximately 1.5 for small diameter boreholes, e.g. six inch diameter. Finally, with respect to the static portion of equation (1) above, the $r_p$ is related to the equivalent source radius $r_s$ by the equation:

$$r_s = \frac{r_p}{\tau_s} \quad (8)$$

where $\tau_s$ is as defined above.

With respect to the transient portion of equation (1) above, the model equation for the pressure transient is:

$$p_{ds}(c_d, S_d, t_d) = \frac{1+s_d}{S_d c_d}\sum_{n=1}^{3}\left\{\frac{1}{y_n}\left(1-\left(1+\frac{x_n S_d}{1+S_d}\right)e^{x_n^2 t_d}\,erfc\left(-x_n\sqrt{t_d}\right)\right)\right\} \quad (9)$$

where $y_n$ is one of:

$$y_1 = x_1(x_1-x_2)(x_1-x_3) \quad (10)$$

$$y_2 = x_2(x_2-x_1)(x_2-x_3) \quad (11)$$

$$y_3 = x_3(x_3-x_1)(x_3-x_2) \quad (12)$$

and where $x_n$ are the three roots of the equation:

$$x^3 + \left(\frac{1+S_d}{S_d}\right)x^2 + \frac{x}{S_d c_d} + \frac{1}{S_d c_d} = 0 \quad (13)$$

Derivation of equation (9) is provided in the appendix of Society of Petroleum Engineers Paper No. SPE 64650, which is incorporated by reference herein as if reproduced in full below, and in Society of Petroleum Engineers Paper No. SPE 62919, which is also incorporated herein by reference as if reproduced in full below.

In similar fashion to the source probe and its related equations described above, the analytic model of the preferred embodiment is also capable of modeling the time series pressure sensed at the vertical probe 20. In the particular case where there is a dip angle between the formation and the well bore, and considering skin, the analytic model of the vertical probe pressure during a draw-down test is:

$$\Delta P_z(z,t) = \left(\frac{Q_0}{4\pi}\frac{\tau_v}{r_v}\frac{\mu}{k_r}\frac{1}{\sqrt{\lambda\sin(\theta)^2+\cos(\theta)^2}}\right)\{r_{dv}p_{dv}(r_{dv},c_d,S_d,t_d)\} \tag{14}$$

where $Q_0$ is the flow rate defined above, $\mu$ is the formation fluid viscosity, $k_r$ is the horizontal permeability, $\lambda$ is the ratio of the vertical to horizontal permeability as defined above, $\theta$ is the dip angle, and $p_d$ is the dimensionless transient pressure response expected for the vertical probe as a function of the dimensionless vertical probe radius $r_{dv}$, the dimensionless compressibility constant $c_d$, the dimensionless skin factor $S_d$ and dimensionless time $t_d$, where the dimensionless $t_d$ is given by the equation:

$$t_d = \frac{t}{\phi c r_s^2}\frac{k_f}{\mu} \tag{15}$$

where $\phi$ is the formation porosity, and c is the total compressibility, and where the dimensionless vertical probe radius $r_{dv}$ is given by:

$$r_{dv} = \frac{r_v}{r_s}\left(\frac{k_r}{k_z}\right)^{\frac{1}{3}} \tag{16}$$

where $r_v$ is the probe spacing.

Similar to the model equation of the source probe equation (14) above is logically divided into a static portion, contained in parenthesis, and a transient portion, contained in brackets. The transient portion of the analytic model representing the vertical probe response is given by:

$$p_{dv}(r_{dv},c_d,S_d,t_d) = \frac{1}{S_d r_{dv} c_d}\sum_{n=1}^{3}\left\{\frac{1}{y_n}\left(erfc\left(\frac{1-r_{dv}}{2\sqrt{t_d}}\right) - e^{(-(1-r_{dv})x_n+x_n^2 t_d)}erfc\left(\frac{1-r_{dv}}{2\sqrt{t_d}} - x_n\sqrt{t_d}\right)\right)\right\} \tag{17}$$

where $r_{dv}$ is dimensionless probe spacing, and where the remaining parameters are as defined above.

By combining equations (1) and (14), the anisotropy for the particular formation is thus as follows:

$$\lambda = \frac{k_z}{k_r} = \left(\frac{(1+S_d)\Delta P_z}{\Delta P_p}\frac{\tau_s r_v}{\tau_v r_s}\sqrt{\lambda\sin(\theta)^2+\cos(\theta)^2}\right)^3 \left\{\frac{p_{dv}(c_d,S_d,t_d)}{(1+S_d)r_{dv}p_{dv}(r_{dv},c_d,S_d,t_d)}\right\}^3 \tag{18}$$

and if the dip angle is zero, this reduces to $$\lambda = \frac{k_z}{k_r} = \left(\frac{(1+S_d)\Delta P_z}{\Delta P_p}\frac{\tau_s r_v}{\tau_v r_s}\right)^3\left\{\frac{p_{dv}(c_d,S_d,t_d)}{(1+S_d)r_{dv}p_{dv}(r_{dv},c_d,S_d,t_d)}\right\}^3 \tag{19}$$

Applying the actual sensed pressure time series to the analytic models exemplified in equations (1) and (14) will not yield the desired formation parameters information in only one calculation. That is, the variables within these equations are manipulated to make the analytic model predicted pressure response match the actual formation test data thus yielding the parameters of interest. Preferably, fluid viscosity $\mu$ is supplied by an external source, such as by MWD tools, or preferably by a viscosity analysis tool or meter coupled to the tool 10. An initial estimate as to the various parameters for the analytical model is made and the results predicted by the analytical model are compared to the actual time series. The parameters are accordingly adjusted, and the model run again using regression analysis techniques known to those of ordinary skill in the art. The regression analysis could take many hundreds or thousands of iterations. The regression analysis stops, in the preferred embodiments, when the modeled pressure response substantially matches the actual pressure response, within approximately five percent. The final state of the manipulated parameters when the regression analysis completes are the formation parameters determined by the model.

In embodiments having two probes, a source probe 18 and a vertical probe 20, the dip angle must be provided for there to be a solution to the equations. Obtaining dip angle prior to running the wireline formation testing of the preferred embodiment may be obtained by many known techniques, including measuring-while-drilling (MWD) devices capable of taking these measurements. Other parameters such as the viscosity of the formation fluid and compressibility of the formation fluid (which manifest itself as the storage effect) may be determined by other downhole tools, including the wireline formation tool itself prior to, during, or after the permeability test described herein. In yet another embodiment, only the source probe could be used, along with the analytical model of equation (1), and in so doing the spherical permeability, along with the skin, could be determined.

In the preferred embodiments, two probes and an externally supplied dip angle are used to determine the horizontal permeability and the permeability anisotropy. The analytic models may be manipulated, however, such that the determination as to permeability may consider only skin, or only dip angle. In the case of a permeability determination taking into consideration skin of the formation, but not dip angle, equation (1) above for the source probe would remain unchanged, but equation (14) modeling the vertical probe response reduces to:

$$\Delta P_Z(t) = \left(\frac{Q_0}{4\pi}\frac{\tau_v}{r_v}\frac{\mu}{k_r}\right)\{r_{dv}p_d(r_{dv}, c_d, S_d, t_d)\} \quad (20)$$

with $P_d$ as defined in equation (9) above.

In the case of a permeability determination taking into dip angle but not skin, equation (1) becomes:

$$\Delta P_p(r_p, t) = \left(\frac{Q_0\tau_s}{4\pi r_p}\frac{\mu}{k_f}\right)p_d(c_d, t_d) \quad (21)$$

where $p_d$ is given by:

$$p_d(c_d, t_d) = \frac{1}{r_d\sqrt{1-4c_d}}\sum_{n=1}^{2}\frac{(-1)^{n+1}}{\beta_n}\left[1 - e^{(\beta_n^2 t_d)}erfc\left(\beta_n\sqrt{t_d}\right)\right] \quad (21)$$

where $\beta_n$ is given substantially by:

$$\beta_1 = \frac{1-\sqrt{1-4c_d}}{2c_d} \quad (23)$$

$$\beta_2 = \frac{1+\sqrt{1-4c_d}}{2c_d} \quad (24)$$

In this second case, taking into account dip angle but not skin, the equation for the vertical probe is the same as equation (14) above.

Numerous variations and modifications will become apparent to those skilled in the art once the above disclosure is fully appreciated. While the preferred embodiment is a wireline formation tester, the system and methods described in this specification could be implemented in tool within a drill string. In an drill string embodiment, drilling ceases during tested, and solving the analytic models described above takes place on a microprocessor or microprocessors within the tool. The results may be stored for later retrieval, or the results or summaries of the results telemetered to the surface using known or after developed techniques. It is intended that the following claims be interpreted to embrace all such variations and modifications.

What is claimed is:

1. A method of performing hydraulic permeability testing of anisotropic earth formations, the method comprising:

coupling a first probe to the earth formation;

coupling a second probe to the earth formation;

inducing a fluid flow from the formation into the first probe;

measuring a pressure response at the first probe caused by the fluid flow;

measuring a pressure response at the second probe caused by the fluid flow; and determining the effect skin of the formation has on a measured hydraulic permeability of the formation, the determination based on the pressure responses measured at the first and second probes.

2. A method of performing hydraulic permeability testing of anisotropic earth formations, the method comprising:

coupling a first probe to the earth formation;

coupling a second probe to the earth formation;

inducing a fluid flow from the formation into the first probe;

measuring a pressure response at the first probe caused by the fluid flow;

measuring a pressure response at the second probe caused by the fluid flow; and determining the effect skin of the formation has on a measured hydraulic permeability of the formation based on the pressure responses measured at the first and second probes, the determining comprising using regression analysis on an analytic model until a set of modeled pressure responses substantially matches the measured pressure responses at the first and second probes wherein a manipulated parameter of the analytic model is indicative of the effect skin of the formation has on the measured hydraulic permeability.

3. The method of performing permeability testing as defined in claim 2 further comprising manipulating parameters of substantially the following equation:

$$\Delta P_p(t) = \left(\frac{(1+S_d)\mu}{k_f}\frac{Q_0}{4\pi}\frac{\tau_s}{r_p}\right)\left\{\frac{p_{ds}(c_d, S_d, t_d)}{(1+S_d)}\right\}$$

where $\Delta P_p$ is the modeled pressure response the first probe, $S_d$ is a dimensionless skin constant, $k_f$ is the spherical permeability, $\mu$ is a formation fluid viscosity, $Q_0$ is the rate of fluid flow from the formation into the first probe, $\tau_s$ is a geometric shape factor for the first probe , $r_p$ is the first probe radius, and $p_{ds}$ is a predicted transient response given substantially by the equation:

$$p_{ds} = \frac{1+S_d}{S_d c_d}\sum_{n=1}^{3}\left\{\frac{1}{y_n}\left(1-\left(1+\frac{x_n S_d}{1+S_d}\right)e^{x_n^2 t_d}\operatorname{erfc}\left(-x_n\sqrt{t_d}\right)\right)\right\}$$

where $c_d$ is a dimensionless compressibility factor of fluid in the earth formation, $t_d$ is dimensionless time, $y_n$ is one of:

$$y_1 = x_1(x_1-x_2)(x_1-x_3)$$

$$y_2 = x_2(x_2-x_1)(x_2-x_3)$$

$$y_3 = x_3(x_3-x_1)(x_3-x_2)$$

and where $x_1$, $x_2$ and $x_3$ are roots of the following equation:

$$x^3 + \left(\frac{1+S_d}{S_d}\right)x^2 + \frac{x}{S_d c_d} + \frac{1}{S_d c_d} = 0.$$

4. The method of performing permeability testing as defined in claim 3 further comprising manipulating substantially the following equation:

$$\Delta P_Z(t) = \left(\frac{Q_o}{4\pi}\frac{\tau_v}{r_v}\frac{\mu}{k_r}\right)\{r_{dv}p_{dv}(r_{dv}, c_d, S_d, t_d)\}$$

where $\Delta P_z$ is the modeled pressure response at the second probe, $\tau_v$ is a geometric shape factor for the second probe, $r_v$ is a physical spacing between first and second probe, $k_r$ is the horizontal permeability, $r_{dv}$ is a dimensionless spacing between the first and second probe and $p_d$ is a predicted transient response given, substantially by the equation:

$$p_{dv}(r_{dv}, c_d, S_d, t_d) = \frac{1}{S_d r_{dv} c_d} \sum_{n=1}^{3} \left\{ \frac{1}{y_n} \left( \begin{array}{l} \operatorname{erfc}\left(\frac{1-r_{dv}}{2\sqrt{t_d}}\right) - \\ e^{(-(1-r_{dv})x_n + x_n^2 t_d)} \operatorname{erfc}\left(\frac{1-r_{dv}}{2\sqrt{t_d}} - x_n\sqrt{t_d}\right) \end{array} \right) \right\}.$$

5. A hydraulic permeability tool, comprising:

a tool body;

a first probe coupled to the tool body, the first probe fluidly couples to a borehole wall, the first probe having a first pressure transducer coupled thereto;

a second probe coupled to the tool body and vertically displaced from the first probe, the second probe fluidly couples to the borehole wall, and the second probe having a second pressure transducer coupled thereto;

a pump coupled to the first probe;

a computer coupled to the first and second pressure probes, and wherein the computer reads pressures responses sensed at the first and second pressure transducers to determine hydraulic permeability anisotropy and skin of a formation taking into account a dip angle between the borehole and the formation.

6. The hydraulic permeability tool as defined in claim 5 wherein the tool body further comprises a wireline logging tool body.

7. The hydraulic permeability tool as defined in claim 5 wherein the tool body further comprises a logging-while-drilling tool body.

8. The hydraulic permeability tool as defined in claim 5 further comprising a fluid viscosity meter coupled to the tool body, and wherein the computer uses a viscosity reading provided by the viscosity meter as part of the determination of the hydraulic permeability.

9. The hydraulic permeability tool as defined in claim 5 wherein the computer implements regression analysis on an analytic model until a set of modeled pressure responses matches the pressure responses sensed at the first and second probes, and wherein parameters of the analytic model predict the formation hydraulic permeability and skin.

10. The hydraulic permeability tool as defined in claim 9 wherein the computer implements the regression analysis on the on the following equation:

$$\Delta P_p = \left(\frac{(1+S_d)\mu}{k_f} \frac{Q_o}{4\pi} \frac{\tau_s}{r_p}\right)\left\{\frac{p_{ds}(c_d, S_d, t_d)}{(1+S_d)}\right\}$$

where $\Delta P_p$ is the modeled pressure reaction the first probe through which a draw-down test is performed, $S_d$ is a dimensionless skin constant, $k_f$ is the spherical permeability, $\mu$ is a formation fluid viscosity, $Q_0$ is the rate of fluid flow from the formation into the first probe, $\tau_s$ is a geometric shape factor for the first probe, $r_p$ is first probe radius, $p_{ds}$ is a predicted transient response given substantially by the equation:

$$p_{ds}(c_d, S_d, t_d) = \frac{1+S_d}{S_d c_d} \sum_{n=1}^{3} \left\{ \frac{1}{y_n} \left(1 - \left(1 + \frac{x_n S_d}{1+S_d}\right) e^{x_n^2 t_d} \operatorname{erfc}\left(-x\sqrt{t_d}\right)\right)\right\}$$

where $c_d$ is a dimensionless compressibility factor of fluid in the formation, $t_d$ is dimensionless time, $y_n$ is one of:

$$y_1 = x_1(x_1 - x_2)(x_1 - x_3)$$

$$y_2 = x_2(x_2 - x_1)(x_2 - x_3)$$

$$y_3 = x_3(x_3 - x_3)(x_3 - x_2)$$

and where $x_1$, $x_2$ and $x_3$ are roots of the following equation:

$$x^3 + \left(\frac{1+S_d}{S_d}\right)x^2 + \frac{x}{S_d c_d} + \frac{1}{S_d c_d} = 0.$$

11. The hydraulic permeability tool as defined in claim 10 wherein the computer implements the regression analysis on the following equation:

$$\Delta P_Z(t) = \left(\frac{Q_o}{4\pi} \frac{\tau_v}{r_v} \frac{\mu}{k_r} \frac{1}{\sqrt{(\lambda\sin(\theta))^2 + (\cos(\theta))^2}}\right)\{r_{dv}\, p_{dv}(r_{dv}, c_d, S_d, t_d)\}$$

where $\Delta P_z$ is the modeled pressure response at the second probe, $\tau_v$ is a geometric shape factor for the second probe, $r_v$ is a distance between the first probe and the second probe, $k_r$ is the horizontal permeability, $\lambda$ is the hydraulic permeability anisotropy, $\theta$ is the angle of the formation relative to an axis of the borehole, $r_{dv}$ is a dimensionless distance between the first probe and the second probe and $p_d$ is a predicted transient response given substantially by the equation:

$$p_{dv}(r_{dv}, c_d, S_d, t_d) = \frac{1}{S_d r_{dv} c_d} \sum_{n=1}^{3} \left\{ \frac{1}{y_n} \left( \begin{array}{l} \operatorname{erfc}\left(\frac{1-r_{dv}}{2\sqrt{t_d}}\right) - \\ e^{(-(1-r_{dv})x_n + x_n^2 t_d)} \operatorname{erfc}\left(\frac{1-r_{dv}}{2\sqrt{t_d}} - x_n\sqrt{t_d}\right) \end{array} \right) \right\}.$$

12. A method comprising:

performing a draw-down test on an anisotropic earth formation traversing a borehole;

detecting formation pressure reactions associated with the draw-down test at a first probe and a second probe;

determining hydraulic permeability anisotropy of the earth formation using the formation pressure reactions and taking into account a dip angle of the earth formation.

13. The method as defined in claim 12 wherein determining the hydraulic permeability anisotropy of the earth formation using the formation pressure reactions and taking into account the dip angle further comprises using regression analysis on an analytic model until a set of modeled pressure reactions substantially matches the formation pressure reactions at the first and second probes.

14. The method as defined in claim 13 wherein using regression analysis further comprises manipulating parameters of substantially the following equation:

$$\Delta P_p(r_p, t) = \left(\frac{Q_o \tau_s}{4\pi r_p}\frac{\mu}{k_f}\right) p_d(c_d, t_d)$$

where $\Delta P_p$ is a modeled pressure response the first probe, $k_f$ is a spherical permeability, $\mu$ is a formation fluid viscosity, $Q_0$ is a rate of fluid flow from the formation into the first probe during the draw-down test, $\tau_s$ is a geometric shape factor for the first probe, $r_p$ is the first probe radius, and $p_d$ is a predicted transient response given substantially by the equation:

$$p_d(c_d, t_d) = \frac{1}{r_d\sqrt{1-4c_d}}\sum_{n=1}^{2}\frac{(-1)^{n+1}}{\beta_n}\left[1 - e^{(\beta_n^2 r_d)}\operatorname{erfc}\left(\beta_n\sqrt{t_d}\right)\right]$$

where $c_d$ is a dimensionless compressibility factor of fluid in the earth formation, $t_d$ is dimensionless time, $r_d$ is equal to 1, $\beta_1$ is given substantially by:

$$\beta_1 = \frac{1-\sqrt{1-4c_d}}{2c_d}$$

and where $\beta_2$ is given substantially by:

$$\beta_2 = \frac{1+\sqrt{1-4c_d}}{2c_d}.$$

15. The method as defined in claim 14 wherein using regression analysis further comprises manipulating substantially the following equation:

$$\Delta P_z(z, t) = \left(\frac{Q_o}{4\pi}\frac{\tau_v}{r_v}\frac{\mu}{k_r}\frac{1}{\sqrt{\lambda\sin(\theta)^2 + \cos(\theta)^2}}\right) r_{dv}\, p_{dv}(r_{dv}, c_d, t_d)$$

where $\Delta P_z$ is the modeled pressure response at the second probe, $\tau_v$ is a geometric shape factor for the second probe, $r_v$ is radius correction factor for the second probe, $k_r$ is the horizontal permeability, $r_{dv}$ is a dimensionless spacing between the first and second probe and $p_{dv}$ is a predicted transient response given substantially by the equation:

$$p_{dv}(r_{dv}, c_d, t_d) = \frac{1}{r_{dv}\sqrt{1-4c_d}}\sum_{n=1}^{2}\left\{\frac{(-1)^{n+1}}{\beta_n}Y_n\right\}$$

where $Y_n$ is given by:

$$Y_n = \operatorname{erfc}\left(\frac{r_d - 1}{2\sqrt{t_d}}\right) - e^{\beta_n(r_d - 1 + \beta_n t_d)}\operatorname{erfc}\left(\beta_n\sqrt{t_d} + \frac{r_d - 1}{2\sqrt{t_d}}\right).$$

16. A logging tool, comprising:

a tool body;

a source probe coupled to the tool body, the source probe fluidly couples to the borehole wall;

a pump coupled to the source probe, the pump displaces fluid through the source probe while the source probe is coupled to the borehole wall;

a first pressure transducer coupled to the source probe, the first pressure transducer senses a pressure response of the formation caused by the displacing of fluid through the source probe; and a computer coupled to the pump and first pressure transducer through the cable, wherein the computer selective controls the pump, and records the pressure response sensed by the first pressure transducer, and wherein the computer determines spherical permeability and skin of the formation adjacent to the borehole wall based on the pressure response sensed.

17. The logging tool as defined in claim 16 wherein the computer performs regression analysis on an analytic model until a modeled pressure response matches the pressure response sensed, and wherein the parameters of the analytic model predict the spherical permeability and the skin.

18. The logging tool as defined in claim 17 wherein the computer implements the regression analysis on the following equation:

$$\Delta P_p = \left(\frac{(1+S_d)\mu}{k_f}\frac{Q_o}{4\pi}\frac{\tau_s}{r_p}\right)\left\{\frac{p_{ds}(c_d, S_d, t_d)}{(1+S_d)}\right\}$$

where $\Delta P_p$ is the modeled pressure response, $S_d$ is a dimensionless skin constant, $k_f$ is the spherical permeability, $\mu$ is a formation fluid viscosity, $Q_0$ is the rate of displaced from the formation into the source probe, $\tau_s$ is a geometric shape factor for the source probe, $r_p$ is the source probe radius, $p_{ds}$ is a predicted transient response given substantially by the equation:

$$p_{ds}(c_d, S_d, t_d) = \frac{1+S_d}{S_d c_d}\sum_{n=1}^{3}\left\{\frac{1}{y_n}\left(1 - \left(1 + \frac{x_n S_d}{1+S_d}\right)e^{x_n^2 t_d}\operatorname{erfc}\left(-x_n\sqrt{t_d}\right)\right)\right\}$$

where $c_d$ is a dimensionless compressibility factor of fluid in the formation, $t_d$ is dimensionless time, $y_n$ is one of:

$$y_1 = x_1(x_1 - x_2)(x_1 - x_3)$$

$$y_2 = x_2(x_2 - x_1)(x_2 - x_3)$$

$$y_3 = x_3(x_3 - x_1)(x_3 - x_2)$$

and where $x_1$, $x_2$ and $x_3$ are roots of the following equation:

$$x^3 + \left(\frac{1+S_d}{S_d}\right)x^2 + \frac{x}{S_d c_d} + \frac{1}{S_d c_d} = 0.$$

19. The logging device as defined in claim 18 further comprising:

a vertically displaced probe coupled to the tool body vertically displaced from the source probe, the vertically displaced probe fluidly couples to the borehole wall;

a second pressure transducer coupled to the vertically displaced probe, the second pressure transducer senses a pressure response of the formation caused by the displacing of fluid through the source probe; and wherein the computer determines the vertical permeability of the formation based on the pressure sensed by the first and second pressure transducers.

20. The logging tool as defined in claim 19 wherein the computer implements regression analysis on an analytic model until a set of modeled pressure responses for the source and vertically displaced probes matches the pressure responses sensed by the first and second pressure transducers, and wherein parameters of the analytic model predict the formation vertical permeability.

21. The logging tool as defined in claim 20 wherein the computer implements regression analysis on the following equation:

$$\Delta P_Z(t) = \left(\frac{Q_o}{4\pi}\frac{\tau_v}{r_v}\frac{\mu}{k_r}\frac{1}{\sqrt{\lambda\sin(\theta)^2+\cos(\theta)^2}}\right)\{r_{dv}p_d(r_{dv}, c_d, S_d, t_d)\}$$

where $\Delta P_z$ is the modeled pressure response at the vertically displaced probe, $\tau_v$ is a geometric shape factor for the vertically displaced probe, $r_v$ is a distance between the source probe and the vertically displaced probe, $k_r$ is the horizontal permeability, $\lambda$ is the hydraulic permeability anisotropy, $\theta$ is the angle of the formation relative to an axis of the borehole, $r_{dv}$ is a dimensionless distance between the source probe and the vertically displaced probe and $p_d$ is a predicted transient response given substantially by the equation:

$$p_{dv}(r_{dv}, c_d, S_d, t_d) = \frac{1}{S_d r_{dv} c_d}\sum_{n=1}^{3}\left\{\frac{1}{y_n}\left(\begin{array}{l}\operatorname{erfc}\left(\frac{1-r_{dv}}{2\sqrt{t_d}}\right)- \\ e^{(-(1-r_{dv})x_n+x_n^2 t_d)}\operatorname{erfc}\left(\frac{1-r_{dv}}{2\sqrt{t_d}}-x_n\sqrt{t_d}\right)\end{array}\right)\right\}.$$

22. A method of determining hydraulic permeability of an anisotropic earth formation traversed by a borehole, the method comprising:

fluidly coupling a source probe to the earth formation;

fluidly coupling a vertically displaced probe to the earth formation;

measuring a pressure reaction at the source probe caused by pulling fluid from the formation into the source probe;

measuring a second pressure reaction at the vertically displaced probe caused by the pulling of fluid from the formation into the source probe;

determining the hydraulic permeability anisotropy of the earth formation with pressure reactions measured at the source and vertically displaced probes, where the determination compensates for damage to the formation near the borehole wall and an angle of the formation relative to an axis of the borehole.

23. The method as defined in claim 22 wherein determining hydraulic permeability anisotropy of the of the earth formation further comprises manipulating parameters of an analytic model until a set of modeled pressure reactions substantially matches the measured pressure reactions at the source and vertically displaces probes.

24. The method of performing permeability testing as defined in claim 23 wherein manipulating parameters of an analytic model further comprises manipulating parameters of substantially the following equation:

$$\Delta P_p = \left(\frac{(1+S_d)\mu}{k_f}\frac{Q_o}{4\pi}\frac{\tau_s}{r_p}\right)\left\{\frac{p_{dv}(c_d, S_d, t_d)}{(1+S_d)}\right\}$$

where $\Delta P_p$ is the modeled pressure reaction the source probe, $S_d$ is a dimensionless skin constant, $k_f$ is the spherical permeability, $\mu$ is a formation fluid viscosity, $Q_0$ is the rate of fluid flow from the formation into the source probe, $\tau_s$ is a geometric shape factor for the source probe, $r_p$ is the source probe radius, $p_{ds}$ is a predicted transient response given substantially by the equation:

$$p_{ds}(c_d, S_d, t_d) = \frac{1+S_d}{S_d c_d}\sum_{n=1}^{3}\left\{\frac{1}{y_n}\left(1-\left(1+\frac{x_n S_d}{1+S_d}\right)e^{x_n^2 t_d}\operatorname{erfc}\left(-x_n\sqrt{t_d}\right)\right)\right\}$$

where $c_d$ is a dimensionless compressibility factor of fluid in the earth formation, $t_d$ is dimensionless time, $y_n$ is one of:

$$y_1 = x_1(x_1-x_2)(x_1-x_3)$$

$$y_2 = x_2(x_2-x_1)(x_2-x_3)$$

$$y_3 = x_3(x_3-x_1)(x_3-x_2)$$

and where $x_1$, $x_2$ and $x_3$ are roots of the following equation:

$$x^3 + \left(\frac{1+S_d}{S_d}\right)x^2 + \frac{x}{S_d c_d} + \frac{1}{S_d c_d} = 0.$$

25. The method of performing permeability testing as defined in claim 24 wherein manipulating parameters of an analytic model further comprises manipulating parameters of substantially the following equation:

$$\Delta P_Z(t) = \left(\frac{Q_o}{4\pi}\frac{\tau_v}{r_v}\frac{\mu}{k_r}\frac{1}{\sqrt{\lambda(\sin(\theta))^2+(\cos(\theta))^2}}\right)\{r_{dv}p_{dv}(r_{dv}, c_d, S_d, t_d)\}$$

where $\Delta P_z$ is the modeled pressure response at the vertically displaced probe, $\tau_v$ is a geometric shape factor for the vertically displaced probe, $r_v$ is a distance between the source probe and the vertically displaced probe, $k_r$ is the horizontal permeability, $\lambda$ is the hydraulic permeability anisotropy, $\theta$ is the angle of the formation relative to an axis of the borehole, $r_{dv}$ is a dimensionless distance between the source probe and the vertically displaced probe and $p_d$ is a predicted transient response given substantially by the equation:

$$p_{dv}(r_{dv}, c_d, S_d, t_d) =$$

-continued $$\frac{1}{S_d r_{dv} c_d}\sum_{n=1}^{3}\left\{\frac{1}{y_n}\left(\begin{array}{l}\operatorname{erfc}\left(\frac{1-r_{dv}}{2\sqrt{t_d}}\right)- \\ e^{(-(1-r_{dv})x_n+x_n^2 t_d)}\operatorname{erfc}\left(\frac{1-r_{dv}}{2\sqrt{t_d}}-x_n\sqrt{t_d}\right)\end{array}\right)\right\}.$$

26. A method comprising:

performing a draw-down test on an anisotropic earth formation traversing a borehole;

detecting pressure responses at a source probe and a vertical probe caused by the draw-down test;

determining hydraulic permeability anisotropy of the of the earth formation using the pressure responses and compensating for damage to the earth formation along a borehole wall.

27. The method as defined in claim 26 wherein determining hydraulic permeability anisotropy further comprises calculating the hydraulic permeability anisotropy with substantially the following equation:

$$\lambda=\frac{k_z}{k_r}=\left(\frac{(1+S_d)\Delta P_z}{\Delta P_p}\frac{\tau_s r_v}{\tau_v r_s}\right)^3$$

where $\lambda$ is the anisotropy, $k_z$ is the vertical permeability, $k_r$ is the horizontal permeability, $\tau_s$ is a geometric shape factor for the source probe, $r_v$ is the radius of the vertical probe, $\tau_v$ is a geometric shape factor for the vertical probe, $r_s$ is the radius of the source probe, $\Delta P_z$ is a steady state pressure drop sensed at the vertical probe during the draw-down, $\Delta P_s$ is a steady state pressure drop sensed at the source probe during the draw-down test, and where $S_d$ is a dimensionless constant representing the damage to the earth formation along a borehole wall determined by recursively solving substantially the following equations until a predicted pressure response matches the detected response:

$$\Delta P_p(t)=\left(\frac{(1+S_d)\mu}{k_f}\frac{Q_o}{4\pi}\frac{\tau_s}{r_p}\right)\left\{\frac{p_{dv}(c_d,S_d,t_d)}{(1+S_d)}\right\}$$

$$\Delta P_Z(t)=\left(\frac{Q_o}{4\pi}\frac{\tau_v}{r_v}\frac{\mu}{k_r}\right)\{r_{dv}p_{dv}(r_{dv},c_d,S_d,t_d)\}$$

where $\Delta P_p(t)$ is the predicted pressure response of the source probe, $\Delta P_z(t)$ is the predicted pressure response of the vertical probe, $k_f$ is the spherical permeability, Qo is a fluid flow rate during the draw-down test, $r_p$ is the radius of the source probe, $\mu$ is a formation fluid viscosity, $r_v$ is a physical spacing between the source and vertical probe, $r_{dv}$ is a dimensionless spacing between the source probe and vertical probe, $p_{ds}$ is a predicted transient response given substantially by the equation:

$$p_{ds}(c_d,S_d,t_d)=\frac{1+S_d}{S_d c_d}\sum_{n=1}^{3}\left\{\frac{1}{y_n}\left(1-\left(1+\frac{x_n S_d}{1+S_d}\right)e^{x_n^2 t_d}\operatorname{erfc}\left(-x_n\sqrt{t_d}\right)\right)\right\}$$

where $c_d$ is a dimensionless compressibility factor of fluid in the earth formation, $t_d$ is dimensionless time, $y_n$ is one of:

$$y_1=x_1(x_1-x_2)(x_1-x_3)$$

$$y_2=x_2(x_2-x_1)(x_2-x_3)$$

$$y_3=x_3(x_3-x_1)(x_3-x_2)$$

where $x_1$, $x_2$ and $x_3$ are roots of the following equation:

$$x^3+\left(\frac{1+S_d}{S_d}\right)x^2+\frac{x}{S_d}+\frac{1}{S_d c_d}=0$$

and where $p_d$ is given substantially by:

$$p_{dv}(r_{dv},c_d,S_d,t_d)=$$

$$\frac{1}{S_d r_{dv} c_d}\sum_{n=1}^{3}\left\{\frac{1}{y_n}\left(\begin{array}{l}\operatorname{erfc}\left(\frac{1-r_{dv}}{2\sqrt{t_d}}\right)- \\ e^{(-(1-r_{dv})x_n+x_n^2 t_d)}\operatorname{erfc}\left(\frac{1-r_{dv}}{2\sqrt{t_d}}-x_n\sqrt{t_d}\right)\end{array}\right)\right\}.$$

28. A method of performing a draw-down test on an anisotropic earth formation traversing a borehole, the method comprising:

detecting pressure responses at a source probe and a vertical probe, each probe fluidly coupled to the earth formation, the pressure responses caused by the draw-down test; and determining hydraulic permeability anisotropy of the of the earth formation using the pressure responses and compensating for damage to the earth formation along a borehole wall and a dip angle of the formation.

29. The method as defined in claim 28 wherein determining hydraulic permeability anisotropy further comprises calculating the hydraulic permeability anisotropy with by solving substantially the following equation:

$$\lambda=\frac{k_z}{k_r}=\left(\frac{(1+S_d)\Delta P_z}{\Delta P_p}\frac{\tau_s r_v}{\tau_v r_s}\sqrt{\lambda\sin(\theta)^2+\cos(\theta)^2}\right)^3$$

where $\lambda$ is the anisotropy, $k_z$ is the vertical permeability, $k_r$ is the horizontal permeability, $\tau_s$ is a geometric shape factor for the source probe, $r_v$ is a distance between the source probe the vertical probe, $\tau_v$ is a geometric shape factor for the vertical probe, $r_s$ is a radius of the source probe, $\Delta P_z$ is a pressure drop sensed at the vertical probe during the draw-down test after all the transients have dissipated, $\Delta P_s$ is a pressure drop sensed at the source probe during the draw-down test after all the transients have dissipated, $\theta$ is the dip angle, and where $S_d$ is a dimensionless constant representing the damage to the earth formation along a borehole wall determined by recursively solving substantially the following equations until a predicted pressure response matches the detected pressure response:

$$\Delta P_p(t)=\left(\frac{(1+S_d)\mu}{k_f}\frac{Q_o}{4\pi}\frac{\tau_s}{r_p}\right)\left\{\frac{p_{ds}(c_d,S_d,t_d)}{(1+S_d)}\right\}$$

-continued $$\Delta P_Z(t) = \left(\frac{Q_o}{4\pi}\frac{\tau_v}{r_v}\frac{\mu}{k_r}\right)\{r_{dv}p_{dv}(r_{dv}, c_d, S_d, t_d)\}$$

where $\Delta P_p(t)$ is the predicted pressure response of the source probe, $\Delta P_z(t)$ is the predicted pressure response of the vertical probe, $k_f$ is the spherical permeability, Qo is a fluid flow rate during the draw-down test, $r_p$ is the radius of the source probe, μ is a formation fluid viscosity, $r_{dv}$ is a dimensionless distance between the source probe and the vertical probe, $p_{ds}$ is a predicted transient response given substantially by the equation:

$$p_{ds}(c_d, S_d, t_d) = \frac{1+S_d}{S_d c_d}\sum_{n=1}^{3}\left\{\frac{1}{y_n}\left(1-\left(1+\frac{x_n S_d}{1+S_d}\right)e^{x_n^2 t_d}\operatorname{erfc}\left(-x_n\sqrt{t_d}\right)\right)\right\}$$

where $c_d$ is a dimensionless compressibility factor of fluid in the earth formation, $t_d$ is dimensionless time, $y_n$ is one of:

$$y_1=x_1(x_1-x_2)(x_1-x_3)$$

$$y_2=x_2(x_2-x_1)(x_2-x_3)$$

$$y_3=x_3(x_3-x_1)(x_3-x_2)$$

where $x_1$, $x_2$ and $x_3$ are roots of the following equation:

$$x^3+\left(\frac{1+S_d}{S_d}\right)x^2+\frac{x}{S_d c_d}+\frac{1}{S_d c_d}=0$$

and where $p_d$ is given substantially by:

$$p_{dv}(r_{dv}, c_d, S_d, t_d) = \frac{1}{S_d r_{dv} c_d}\sum_{n=1}^{3}\left\{\frac{1}{y_n}\left(\operatorname{erfc}\left(\frac{1-r_{dv}}{2\sqrt{t_d}}\right)-e^{(-(1-r_{dv})x_n+x_n^2 t_d)}\operatorname{erfc}\left(\frac{1-r_{dv}}{2\sqrt{t_d}}-x_n\sqrt{t_d}\right)\right)\right\}.$$

30. A method of performing a draw-down test on an anisotropic earth formation traversing a borehole, the method comprising:

coupling a source probe and a vertical probe to the earth formation;

detecting formation pressure reactions associated with the draw-down test at the source probe and the vertical probe;

determining hydraulic permeability anisotropy of the earth formation using the formation pressure reactions and taking into account a dip angle of the earth formation.

31. The method of performing a draw-down test on an anisotropic earth formation traversing a borehole as defined in claim 30 wherein determining hydraulic permeability anisotropy of the earth formation further comprises solving the substantially the following equation:

$$\lambda = \frac{\left(\frac{1}{6}\frac{A_3^3}{A_1^3\sin(\theta)}+\frac{2}{3}A_4+\frac{1}{3}\frac{1}{A_1^3\sin(\theta)}\right)^2-\cos(\theta)}{\sin(\theta)}$$

where λ is the anisotropy, θ is the dip angle and where:

$$A_1 = \left(\frac{\Delta P_z}{\Delta P_p}\frac{\tau_s r_v}{\tau_v r_s}\right)^3\left\{\frac{p_d(c_d, t_d)}{r_{dv}p_{dv}(r_{dv}, c_d, t_d)}\right\}^3$$

$$A_2=A_1^6\cos(\theta)\sin(\theta)$$

$$A_3=-108A_2+8+12A_1^3\sin(\theta)\sqrt{3\cos(\theta)(27A_2-4)}$$

$$A_4 = \frac{1}{A_1^3\sin(\theta)^3\sqrt{A_3}}$$

where $\tau_s$ is a geometric shape factor for the source probe, $r_v$ is a distance between the source probe and the vertical probe, $\tau_v$ is a geometric shape factor for the vertical probe, $r_s$ is the equivalent source probe radius, $\Delta P_z$ is a steady state pressure drop sensed at the vertical probe during the draw-down, $\Delta P_s$ is a steady state pressure drop sensed at the source probe during the draw-down test, $p_d(c_d, t_d)$ is given substantially by:

$$p_{ds}(c_d, t_d) = \frac{1}{\sqrt{1-4c_d}}\sum_{n=1}^{2}\frac{(-1)^{n+1}}{\beta_n}\left[1-e^{(\beta_n^2 t_d)}\operatorname{erfc}\left(\beta_n\sqrt{t_d}\right)\right]$$

where $r_d$ is 1, $c_d$ is a dimensionless compressibility factor of formation fluids, $t_d$ is dimensionless time and $\beta_n$ is one of:

$$\beta_1 = \frac{1-\sqrt{1-4c_d}}{2c_d}$$

$$\beta_2 = \frac{1+\sqrt{1-4c_d}}{2c_d}$$

and where $p_d(r_{dv}, c_d, t_d)$ is given substantially by:

$$p_{dv}(r_{dv}, c_d, t_d) = \frac{1}{r_{dv}\sqrt{1-4c_d}}\sum_{n=1}^{2}\frac{(-1)^{n+1}}{\beta_n}\left[1-e^{(\beta_n^2 t_d)}\operatorname{erfc}\left(\beta_n\sqrt{t_d}\right)\right]$$

where $r_{dv}$ is a dimensionless distance between the source probe and the vertical probe.

* * * * *